US006255955B1

(12) United States Patent
Blaettner

(10) Patent No.: US 6,255,955 B1
(45) Date of Patent: Jul. 3, 2001

(54) BRUSH WARNING INDICATOR AND METHODS FOR INDICATING BRUSH WEAR-OUT

(75) Inventor: Harald Edmund Blaettner, Fort Wayne, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/318,674

(22) Filed: May 25, 1999

(51) Int. Cl.[7] ..... G08B 21/00
(52) U.S. Cl. ..... 340/648; 340/679
(58) Field of Search ..... 340/648, 679; 310/242, 245, 247, 248, 249

(56) References Cited

U.S. PATENT DOCUMENTS

| | | | | |
|---|---|---|---|---|
| 4,172,988 | * | 10/1979 | Lowther | 310/245 |
| 4,272,695 | * | 6/1981 | Buchwald et al. | 310/242 |
| 4,344,009 | | 8/1982 | Reynolds . | |
| 4,344,072 | | 8/1982 | Harper, Jr. . | |
| 4,348,608 | | 9/1982 | Michael . | |
| 4,420,705 | | 12/1983 | Kimberlin . | |
| 4,488,078 | * | 12/1984 | Orton | 310/242 |
| 4,513,495 | | 4/1985 | Kimberlin . | |
| 4,723,084 | | 2/1988 | Reynolds . | |
| 4,739,208 | | 4/1988 | Kimberlin . | |
| 4,743,787 | | 5/1988 | Bunner et al. . | |
| 4,761,594 | | 8/1988 | Rodi et al. . | |
| 4,831,302 | | 5/1989 | Dietrich et al. . | |
| 4,918,348 | * | 4/1990 | Fitzsimmons et al. | 310/242 |
| 4,950,933 | * | 8/1990 | Pipkin et al. | 310/239 |
| 4,977,345 | | 12/1990 | Toperzer . | |
| 5,731,650 | | 3/1998 | Scheucher . | |
| 5,753,995 | | 5/1998 | Ogino . | |

* cited by examiner

*Primary Examiner*—Jeffery Hofsass
*Assistant Examiner*—Son Tang
(74) *Attorney, Agent, or Firm*—Carl B. Horton, Esq.; Damian Wasserbauer, Esq.; Armstrong Teasdale LLP

(57) ABSTRACT

A brush warning indicator for an electric motor is described. The brush warning indicator includes a contact spring having a non-conductive bushing connected to a conductive member. The contact spring is connected to a brush yoke by a terminal. The non-conductive bushing contacts a brush in a brush holder and biases the contact spring in relation to the brush holder. Once the brush moves beyond a predetermined point, the conductive member contacts a contact rivet and relays a voltage to a remote location where an indicator signals that the brush has worn beyond the predetermined point.

20 Claims, 5 Drawing Sheets

BRUSH WARNING INDICATOR AND METHODS FOR INDICATING BRUSH WEAR-OUT

BACKGROUND OF THE INVENTION

This invention relates generally to electric motors and, more particularly, to a brush warning indicator in an electric motor.

Electric motors typically are devices which convert electric energy into mechanical energy through the utilization of magnetic fields. Direct current electric motors utilize carbon brushes to transfer an electrical current between an external source and rotating commutators mounted on an armature of a rotor mounted in the motor.

The armature includes armature coils connected to two commutator bars. The electrical current flows through the carbon brushes into the contacting commutators and armature coils. The electrical current induces a magnetic field in the armature. Magnets in the frame of the motor generate magnetic fields which repel/attract fields in the armature. The direction of the current flowing through the armature is constantly changing, resulting in a constantly changing magnetic field. This change of current flow causes the rotor to rotate and produce mechanical energy.

The brushes are held in contact with the commutator using mechanical springs. As brushes wear beyond a point of minimum brush spring force, the springs may no longer maintain the brushes in contact with the commutator. It is known to utilize brush wear indicators to signal the need for brush replacement. Typically, such indicators include limit switches or leads inserted into the brush, to signal when the brush is worn beyond a predetermined point of wear and should be replaced. A voltage equal to the armature voltage can then be detected at an output terminal of a limit switch or lead, to indicate that the brush should be replaced.

These known brush wear indicators increase the cost and complexity of electric motors. Further, the utilization of switches activated by brush spring movement may fail or malfunction due to the complexity of these indicators. In addition, indicators that utilize leads inserted into the brush are typically metallic and may contact the commutator and result in metal on metal structural damage.

Accordingly, it would be desirable to decrease the cost of a brush warning indicator. Additionally, it would be desirable to decrease the complexity of the brush warning indicator.

BRIEF SUMMARY OF THE INVENTION

In an exemplary embodiment of the invention, a brush warning indicator includes four contact springs and four brushes. Each contact spring is in contact with a respective brush in a brush holder attached to a brush yoke. When the brush moves beyond a predetermined point, each contact spring contacts a respective brush holder rivet. Contact with the rivet generates a voltage in the contact spring which is equal to the brush voltage. A terminal, connected to the contact spring, relays the voltage to a remote location which indicates that the brush is worn out and should be replaced.

The contact spring allows for an increased reliability of the brush warning indicator. Each contact spring is attached to the existing brush yoke with the terminal. In addition, each contact spring is inserted through respective openings in the brush yoke to provide contact with the respective brushes.

DETAILED DESCRIPTION OF THE INVENTION

Figure 1:
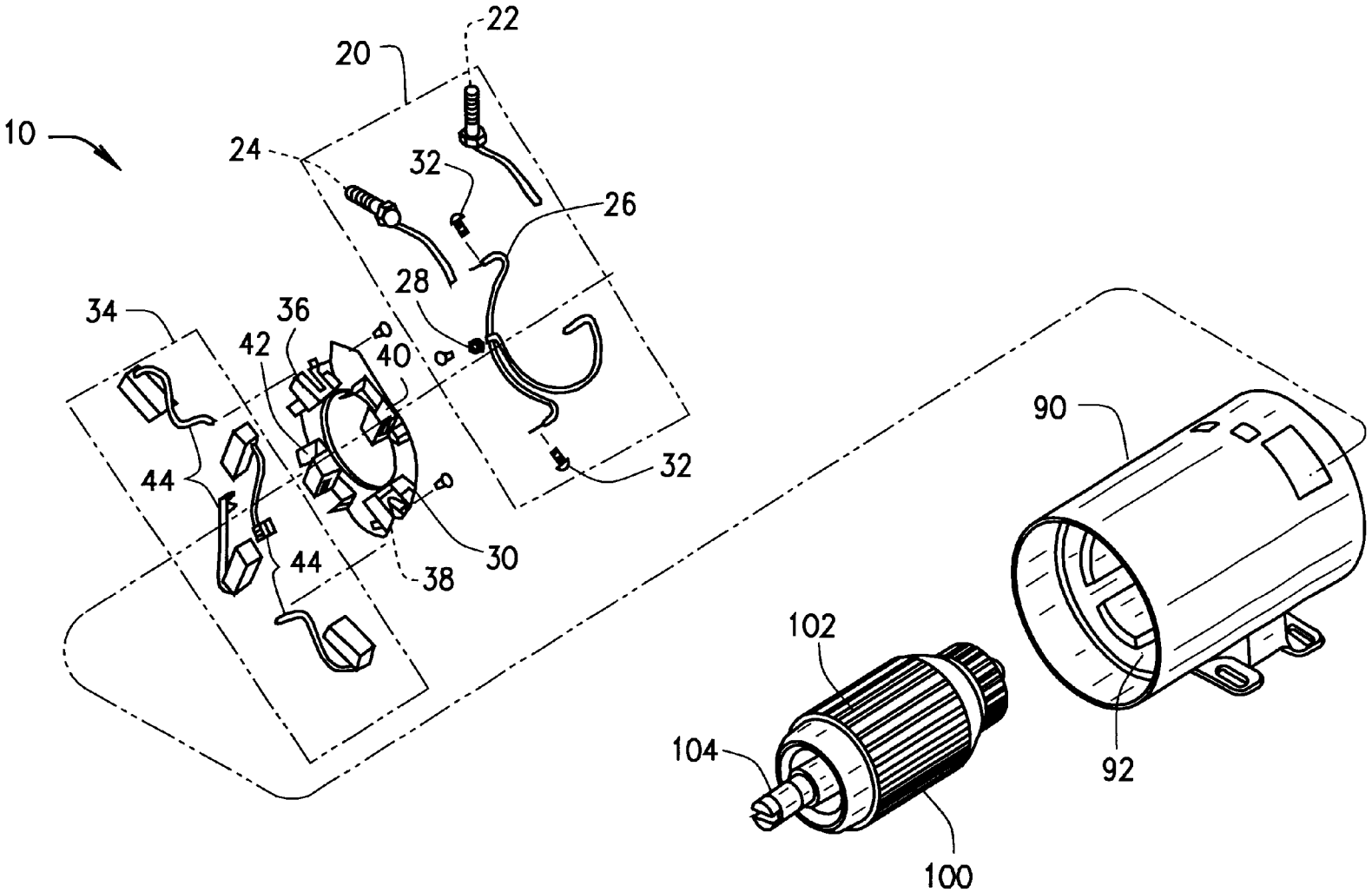
FIG. 1 is an exploded view of an electric motor including a brush yoke.

FIG. 1 is an exploded view of a direct current electric motor 10. Motor 10 includes a current distribution assembly 20 which includes a positive stud 22 and a negative stud 24. Positive stud 22 and negative stud 24 are connected to a first cross connector 26 and a second cross connector 28, respectively. Current distribution assembly 20 is attached to a brush yoke 30 by a plurality of terminal screws 32.

A plurality of brushes 34 are mounted onto brush yoke 30 with a plurality of brush holders 36, 38, 40, and 42. In one embodiment, brush yoke 30 includes four brush holders 36, 38, 40, and 42 and four brushes 34. Alternatively, brush yoke 30 could include any number of brush holders 36 and brushes 34. First cross connector 26 connects a first brush holder 36 to a second brush holder 38 and second cross connector 28 connects a third brush holder 40 to a fourth brush holder 42. Each brush 34 includes a respective shunt 44 which is situated in brush yoke 30 at a respective brush holder 36, 38, 40, and 42. Shunts 44 are also connected to first cross connector 26 or second cross connector 28. Brush holders 36, 38, 40, and 42 are attached to brush yoke 30 by a plurality of rivets (shown in FIGS. 2 and 3).

Motor 10 further includes a motor frame 90 and an armature 100. Motor frame 90 includes a plurality of magnets 92 and surrounds armature 100. Armature 100 includes a commutator 102 and an armature shaft 104. Brush yoke 30 is inserted into motor frame 90 and surrounds armature 100. Commutator 102 surrounds armature shaft 104.

Figure 2:
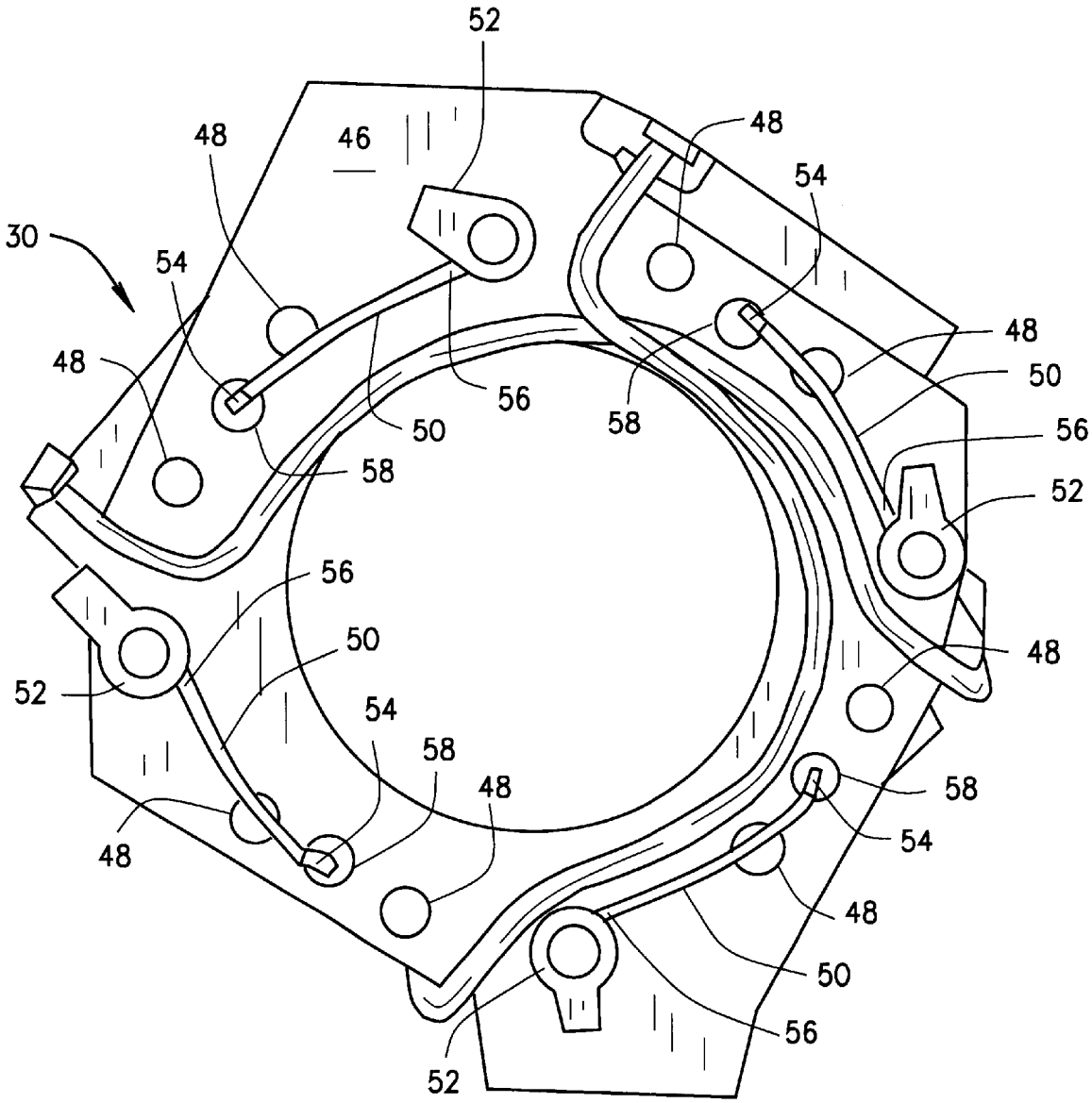
FIG. 2 is a front view of the brush yoke shown in FIG. 1.

FIG. 2 illustrates a first surface 46 of brush yoke 30 including a plurality of contact rivets 48 and a plurality of contact springs 50. Contact springs 50 are connected to brush yoke 30 by a plurality of terminals 52. Contact springs 50 include a non-conductive portion, or bushing, 54 and a conductive portion, or member, 56. Brush yoke 30 further includes an opening 58 through which nonconductive portion 54 of contact spring 50 extends.

Figure 3:
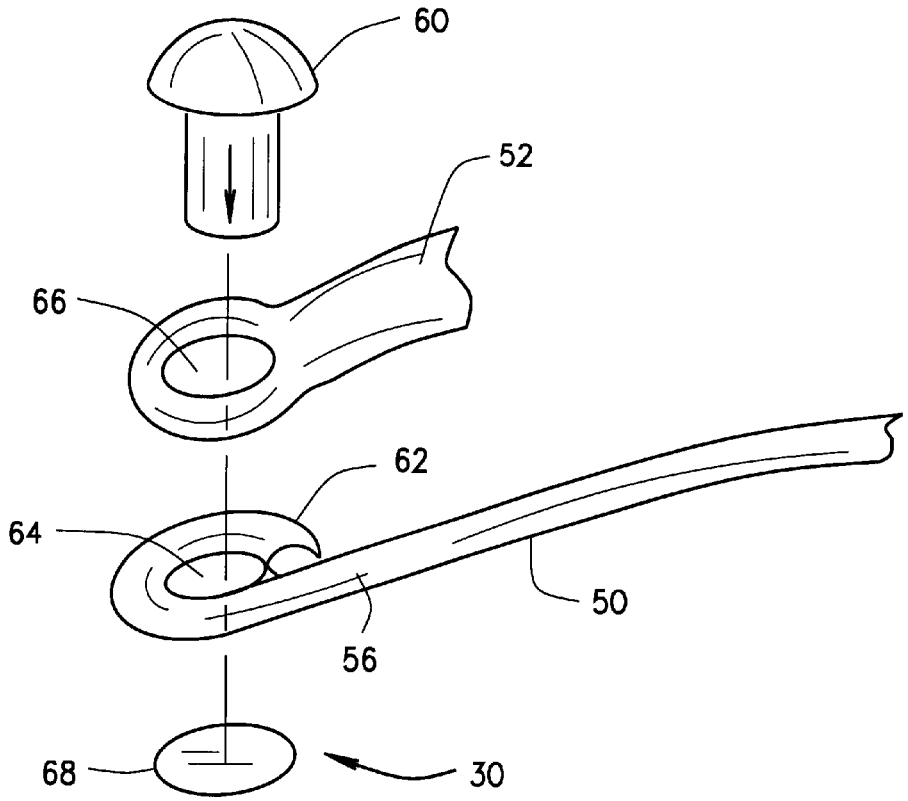
FIG. 3 is a view of a contact spring, terminal, and rivet utilized on the brush yoke shown in FIG. 2.

FIG. 3 illustrates conductive portion 56 of contact spring 50, a terminal rivet 60, and terminal 52. Contact springs 50 are strips, or rods, fabricated from a metal such as stainless steel, and are arcuate in shape. Terminals 52 are fabricated from brass and terminal rivets 60 are fabricated from steel. Conductive portion 56 of contact spring 50 includes a loop portion 62 with an opening 64 therethrough. Terminals 52 are connected to conductive members 56 by terminal rivets 60 which extend through an opening 66 in terminal 52, opening 64 in conductive portion 56 and a respective opening 68 in brush yoke 30. Conductive portion 56 is in electrical contact with terminal 52.

Figure 4:
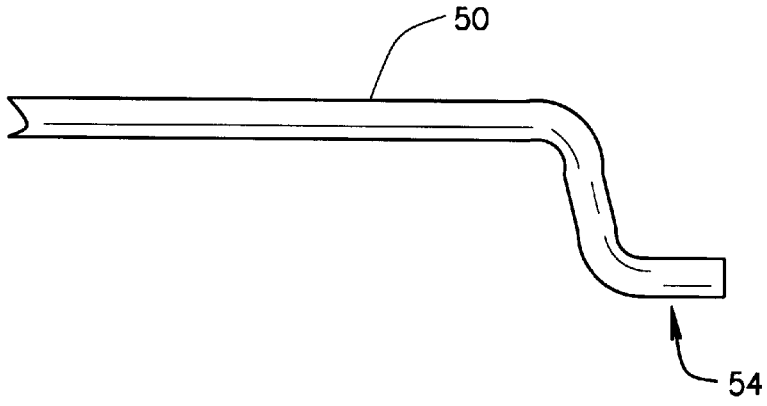
FIG. 4 is a perspective view of the contact spring shown in FIG. 3.

FIG. 4 is a perspective illustration of contact spring 50. Non-conductive portion 54 of contact spring 50 is coated with a high temperature and non conductive epoxy, such as epoxy insulating powder 5230, commercially available from 3M Corporation, St. Paul, Minn. Non-conductive portion 54 is curved to permit non-conductive portion 54 of contact spring 50 to extend through brush yoke opening 58 (shown in FIG. 2) as will be described in greater detail below.

Figure 5:
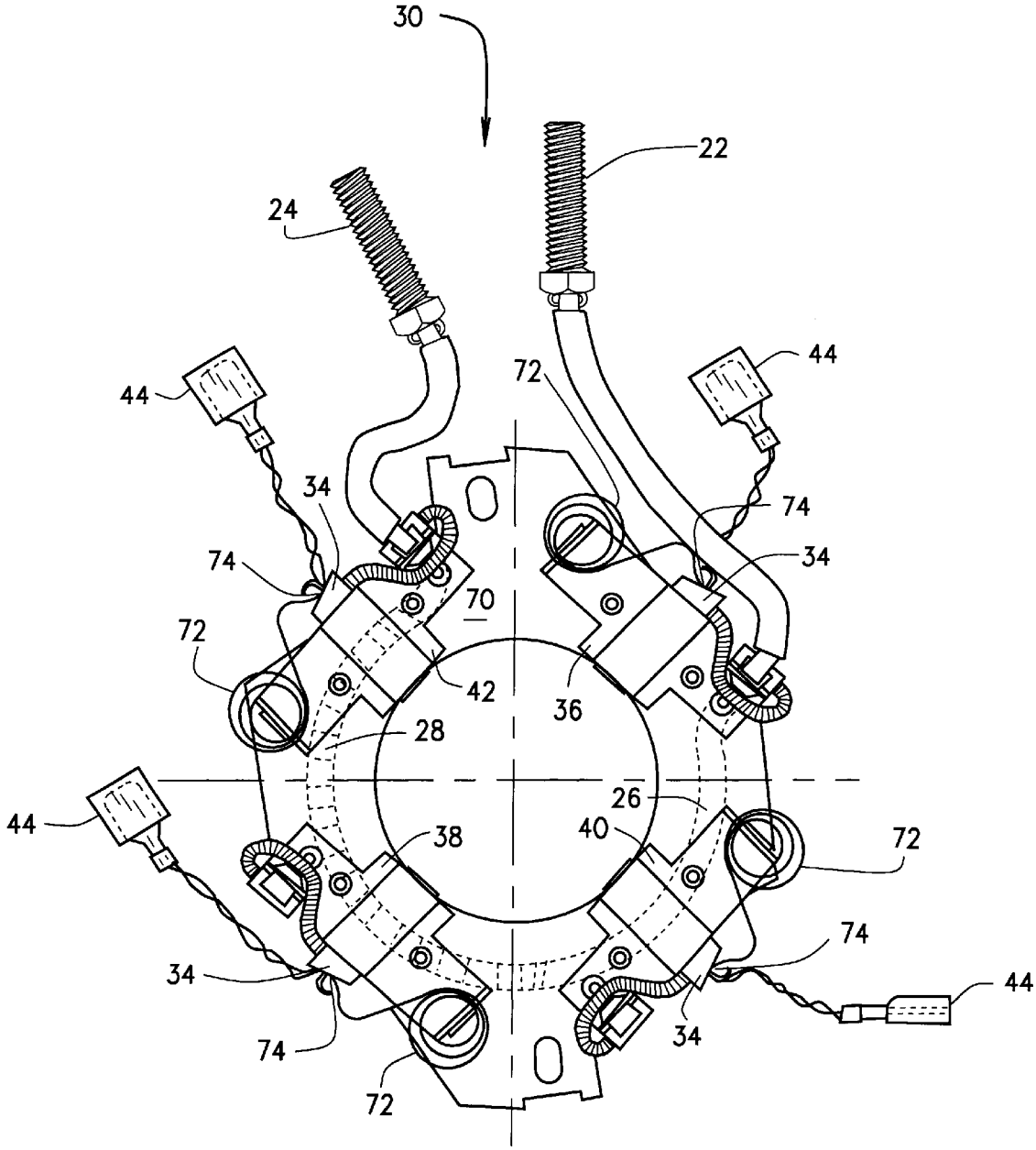
FIG. 5 is a rear view of the brush yoke shown in FIG. 2.

FIG. 5 illustrates a second surface 70 of brush yoke 30 including a plurality of brush springs 72. Each brush spring 72 is connected to brush yoke 30 and contacts a brush spring end 74 of a respective brush 34. Brush springs 72 maintain brushes 34 in contact with a commutator (shown in FIG. 1) by applying a force to brush spring ends 74.

Figure 6:
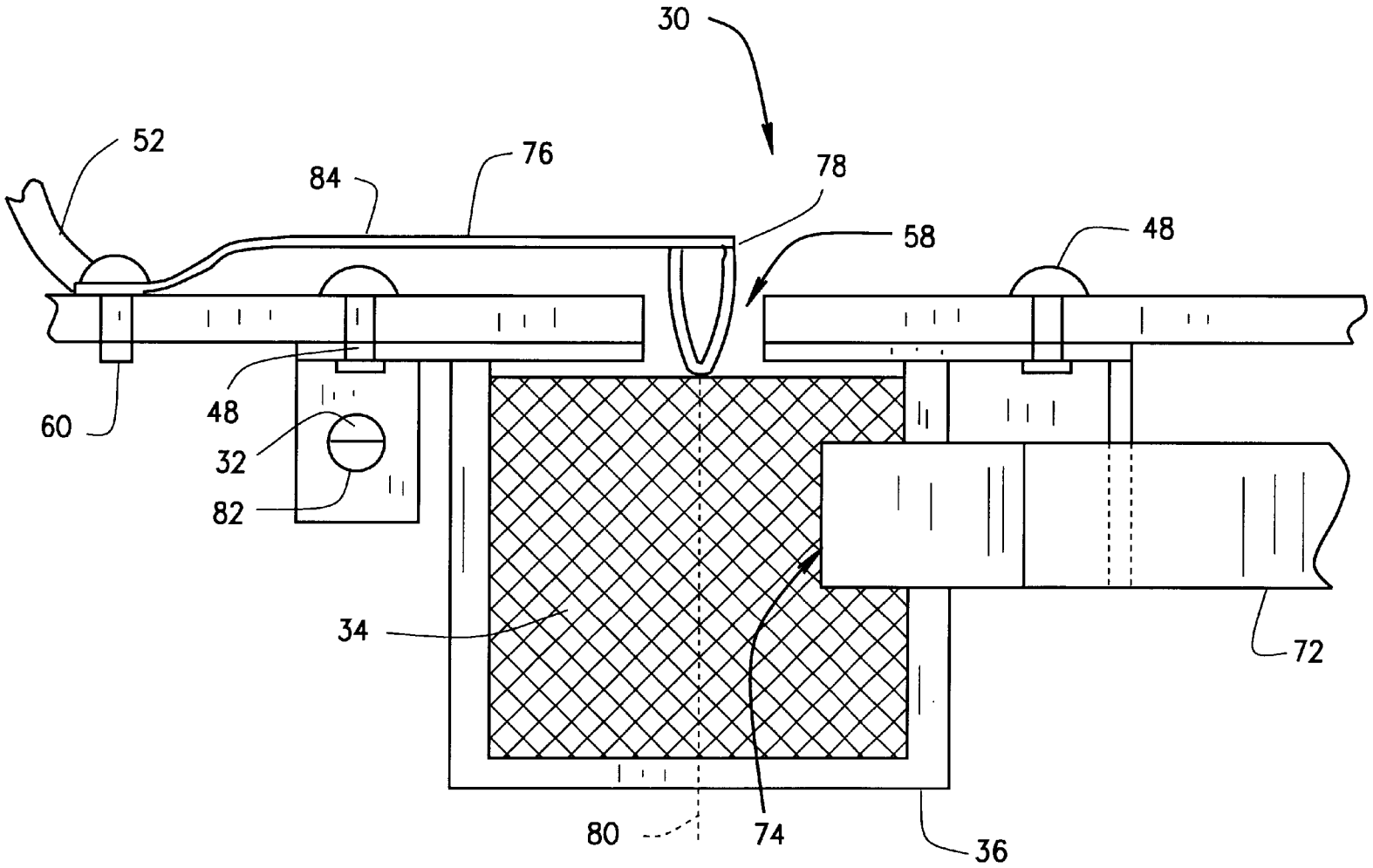
FIG. 6 is a top view of an alternate embodiment of a contact spring.

FIG. 6 is a top illustration of brush yoke 30 including an alternate embodiment of a contact spring 76. Contact spring 76 is similar to contact spring 50 (shown in FIGS. 2, 3, and 4) except that curved non-conductive portion 54 been replaced by a nonconductive portion 78 which is substantially cone shaped. As shown in FIG. 6, opening 58 extends through brush yoke 30 at an approximate centerline 80 of each brush holder 36, 38, 40, and 42 and communicates with a respective brush 34. Each nonconductive portion 78 extends through a respective opening 58 and contacts a respective brush 34. Non-conductive portion 78 is fabricated from a polyphthalamide thermoplastic, commercially available from Mack Plastics Corporation, Bristol R.I.

Brush spring 72 contacts brush 34 at brush spring end 74. Brush 34 includes shunt 44 (shown in FIGS. 1 and 5) which is connected to second cross connector 28 (shown in FIG. 5) at an opening 82 by terminal screw 32. Nonconductive portion 78 and a conductive portion 84 of contact spring 76 are separated from contact rivets 48 and cross connectors 26 and 28 by a predetermined distance. Conductive portions 84 of contact springs 76 are separated from contact rivets 48 by a distance of about one eighth of an inch. Terminals 52 are separated from connectors 26 and 28 by a distance of about one fourth of an inch. Alternatively, the separation distances could be greater or less than one eighth of an inch and one quarter of an inch, respectively. Brush yoke 30 is fabricated from a high temperature and non-conductive material. An exemplary material is Haysite-HSTI 1, a glass material base laminated polyester sheet, commercially available from Haysite Reinforced Plastics, Erie, Pa.

In operation, a current flows from a power source (not shown) through cross connectors 26 and 28, brush holders 36, 38, 40, and 42, rivets 48, brushes 34, and commutators 102 (shown in FIG. 1) such that alternate brush holders 36, 38, 40, and 42 have opposite polarities. Brushes 34 are maintained in contact with commutators 102 by brush springs 72 and become worn. Provided brushes 34 are not worn beyond a predetermined wear point, conductive members 84 of contact springs 76 do not contact rivets 48, since non-conductive portions 54, or alternatively cones 78, contact brushes 34.

Eventually, however, brushes 34 wear beyond a predetermined wear point and contact between nonconductive portion 54, or cone 78, and brush 34 is broken. Contact between non-conductive portion 54, or cone 78, and brush 34 is broken when brush spring end 74 of brush 34 moves beyond opening 58. Spring 72 then snaps forward and non-conductive bushing 54, or cone 78, extends through opening 58 until conductive member 76 electrically contacts rivet 48.

Since rivets 48 are electrically connected to brushes 34, contact spring 50 or 76, registers a voltage and terminals 52 are at the brush voltage when conductive portion 56, or 84, electrically contacts rivets 48. Terminals 52 relay the voltage at rivet 48 to a remote location where a voltage signal (not shown) or indicator (not shown) signals that brush 34 has moved beyond the predetermined wear point. The specific brush 34 which moved beyond the predetermined wear point may also be indicated.

The contact spring described above provides increased reliability for a brush warning indicator. Additionally, the contact spring decreases the complexity of the brush warning indicator compared with known brush warning indicators. Further, the cost of fabricating the brush warning indicator is decreased due to the decreased complexity.

While the invention has been described in terms of various specific embodiments, those skilled in the art will recognize that the invention can be practiced with modifications within the spirit and scope of the claims.

What is claimed is:

1. An electric motor comprising:

an armature comprising an armature shaft;

a plurality of commutators mounted onto said armature; and at least one brush yoke surrounding said plurality of commutators, said brush yoke comprising a plurality of contact springs, a plurality of brushes, and a plurality of conductive brush holder rivets in electrical contact with said brushes, said brushes in contact with said commutators, said contact springs configured to indicate movement of said brushes beyond a predetermined point.

2. An electric motor in accordance with claim 1 further comprising:

at least one positively charged terminal and at least one negatively charged terminal;

a plurality of cross connectors connected to said plurality of brushes, said cross connectors further connected to said at least one positively charged terminal and said at least one negatively charged terminal; and a frame surrounding said positively charged terminal, said negatively charged terminal, and said cross connectors, said frame comprising a plurality of magnets surrounding said armature.

3. An electric motor in accordance with claim 2 wherein said brush yoke further comprises:

a plurality of brush holders connected to said cross connectors, said conductive brush holder rivets fixedly attached to said brush holders; and a plurality of openings, each said opening extending through one of said brush holders and in communication with one of said brushes.

4. An electric motor in accordance with claim 3 wherein each said brush comprises a shunt, said shunts connected to said brush yoke, each said shunt connected to one of said brush holders and one of said cross connectors.

5. An electric motor in accordance with claim 4 wherein each said contact spring comprises:

a plurality of non-conductive bushings, each said bushing extending through one of said openings and contacting one of said brushes, said non-conductive bushings separated from said brush yoke by a first predetermined distance; and a plurality of conductive members connected to said non-conductive bushings, said conductive members separated from said brush holder rivets by a second predetermined distance.

6. An electric motor in accordance with claim 5 wherein each said terminal is connected to one of said conductive members, each said terminal configured to register a voltage when a respective said conductive member contacts said brush holder rivet.

7. An electric motor in accordance with claim 5 wherein said non-conductive bushings are substantially cone shaped.

8. A brush yoke comprising:

a plurality of brushes;

a plurality of contact springs, each said contact spring in contact with a respective said brush, each said contact spring configured to transmit a signal when said respective brush moves beyond a predetermined point; and a plurality of conductive brush holder rivets electrically connected to said brushes.

9. A brush yoke in accordance with claim 8 further comprising a plurality of brush holders, each said brush holder comprising said respective brush, said plurality of rivets connecting each said brush holder to said brush yoke.

10. A brush yoke in accordance with claim 9 wherein said brush holders comprise four brush holders.

11. A brush yoke in accordance with claim 10 wherein each said brush comprises a shunt connected to a respective said brush holder.

12. A brush yoke in accordance with claim 11 further comprising a plurality of openings.

13. A brush yoke in accordance with claim 12 wherein each said opening extends through a respective said brush holder.

14. A brush yoke in accordance with claim 13 wherein each said contact spring comprises a non-conductive portion, each said non-conductive portion extending through a respective said opening and contacting a respective said brush in a respective said brush holder.

15. A brush yoke in accordance with claim 14 wherein each said contact spring further comprises a conductive portion, each said conductive portion separated from a respective said rivet by a predetermined distance.

16. A brush yoke in accordance with claim 15 further comprising a plurality of terminals, each said conductive portion connected to a respective said terminal.

17. A method for assembling a brush warning indicator in an electric motor including an armature including a plurality of commutators, a brush yoke including a plurality of brush holders, each brush holder having a brush mounted therein, a plurality of openings extending through the brush yoke and through a respective brush holder, a plurality of shunts connected to the brush yoke, each shunt connected to a respective brush holder, a plurality of contact springs, each contact spring including a conductive portion and a non-conductive portion, a terminal connected to each conductive portion of each contact spring, and a plurality of conductive brush holder rivets connecting each brush holder to the brush yoke, each said rivet electrically connected to a respective brush, said method comprising the steps of:

attaching the terminals and the contact springs to the brush yoke; and biasing each contact spring in relation to the respective brushes and conductive brush holder rivets.

18. A method in accordance with claim 17 wherein said step of biasing each contact spring comprises the steps of:

positioning the conductive portion of the contact spring a predetermined distance from the brush holder rivets; and extending the non-conductive portion of the contact spring through a respective opening in the brush yoke and a respective brush holder, such that the non-conductive portion contacts the brush.

19. A method in accordance with claim 17 wherein each contact spring includes a conductive portion and a substantially cone shaped non-conductive portion, said step of biasing each contact spring comprises the steps of:

positioning the conductive portion of the contact spring a predetermined distance from the brush holder rivets; and extending the substantially cone shaped non-conductive portion of the contact spring through a respective opening in the brush yoke and a respective brush holder, such that the substantially cone shaped non-conductive portion contacts the brush.

20. A method in accordance with claim 18 wherein said step of positioning the conductive portion includes the step of positioning the conductive portion to contact the brush holder rivet when the non-conductive portion no longer contacts the brush.

* * * * *